United States Patent [19]

Prenntzell

[11] 3,964,604

[45] June 22, 1976

[54] FLEXIBLE COMPARTMENTED PACKAGE

[76] Inventor: Kurt Prenntzell,
Ferdinand-Tonnies-Strasse 8, 242
Eutin, Germany

[22] Filed: Dec. 23, 1974

[21] Appl. No.: 535,304

[30] Foreign Application Priority Data

Dec. 21, 1973 Germany ..... 2363904

[52] U.S. Cl. ..... 206/219; 96/76 C; 206/455

[51] Int. Cl.[2] ..... B65D 25/08; B65D 81/32; G03C 1/48

[58] Field of Search ..... 206/219, 220, 455; 23/253 R; 96/76 C

[56] References Cited

UNITED STATES PATENTS

| | | | |
|---|---|---|---|
| 3,419,719 | 12/1968 | Goffe et al. | 206/219 |
| 3,785,771 | 1/1974 | Lushsinger et al. | 23/253 R |
| 3,794,490 | 2/1974 | Nerwin | 96/76 C |
| 3,833,381 | 9/1974 | Chen et al. | 96/76 C |

FOREIGN PATENTS OR APPLICATIONS

| | | | |
|---|---|---|---|
| 697,723 | 9/1953 | United Kingdom | 206/219 |

*Primary Examiner*—Willliam T. Dixson, Jr.
*Attorney, Agent, or Firm*—Edward F. Levy

[57] ABSTRACT

A flexible compartmented package having a primary chamber serving as a mixing or reaction chamber, and one or more secondary chambers capable of being filled with a liquid, paste or similar substance to be mixed or reacted with a substance contained in the primary chamber. To enable any of the secondary chambers to be joined with the primary chamber in communication therewith, each of the secondary chambers is separated from the primary chamber by a sealing seam having a portion capable of being ruptured to destroy the seal by means of applying pressure to the secondary chamber which is intended to be joined with the primary chamber.

10 Claims, 3 Drawing Figures

FLEXIBLE COMPARTMENTED PACKAGE

BACKGROUND OF THE INVENTION

The present invention relates to a novel and improved flexible compartmented package made of a thermoplastic film or a lamination of such films, the package comprising a first chamber able to be employed for the reaction or mixing of substances, and one or more secondary chambers adapted to be filled with fluid or plastic substances. The secondary chambers are separated from the first chamber by means of a sealing seam and are adapted to be brought into communication with the first chamber by destroying a part of the sealed seam.

In German patent application Ser. No. 2,259,014, there is described a multicompartment package in which reactive substances are contained within dimples formed in the the bottom of containing chambers of rectangular form and having an end formed by an obtuse angle. A group of such containing chambers are located within a larger test chamber filled with a test fluid. The sealed seams surrounding the containing chambers are made so that they may be easily destroyed. In order to cause a reactive substance contained in a containing chamber to react with the test fluid contained in the test chamber, the walls of the test chamber are gripped manually in front of the containing chamber end which forms an obtuse angle and these walls are pulled away from each other. Such a multicompartment package is unduly restricted in size and shape since the test chamber must be of such size and form to enable the user to grip its walls and pull them away from each other. In addition, the sealing seams surrounding the containing chambers and the sealing seam enclosing the test chamber must be made in separate operations.

It is the principal object of the present invention to provide an improved multicompartment package which avoids the aforesaid disadvantages and which will enable a user to join any of the secondary chambers separately to the primary chamber. Such joining is accomplished at a predetermined location and in a simple manner by merely squeezing or pressing the filled secondary chamber.

Another object of the invention is to provide an improved multicompartment package in which one or more secondary chambers are each separated from a primary chamber by a sealing seam having a rupturable portion which is destroyed to break the seal when the secondary chamber is squeezed or pressed, and in which the rupturable portion is of such construction as to insure the destruction thereof even if the secondary chamber has a small or narrow form.

Still another object of the invention is to provide a multicompartment package of the character described in which the rupturable portion of the seal is so located that the charge of substance in the secondary chamber, of rectangular or tapered form, may be transferred over entirely into the primary chamber.

Still another object of the invention is the provision of a multicompartment package of the character described which is of such construction as to enable the recycling of the substances mixed in the primary chamber back to secondary chamber after the rupturable portion of the seal has been destroyed and the substance in the secondary chamber has been transferred to the primary chamber for mixing.

A further object of the invention is the provision of a multicompartment package of the character described which is so constructed as to enable the combining of separate substances from two secondary chambers before transferring such substances to the primary chamber.

A further object of the invention is to provide a multicompartment package capable of serving as an X-ray package containing X-ray film and encapsulated substances for developing and fixing said X-ray film in the package, in an extremely easy and convenient manner by simple manual manipulation of the package.

SUMMARY OF THE INVENTION

In accordance with the invention there is provided a flexible compartmented package comprising a primary chamber and at least one secondary chamber which is formed as an entirely sealed and enclosed pressure compartment and which is separated from the primary chamber by a sealed seam. The sealed seam has a rupturable portion in the form of a nose protruding into the secondary chamber and having a tapered tip of either V-shape or U-shape. Joining of a preselected secondary chamber with the primary chamber is easily accomplished simply by squeezing the walls of the secondary chamber and causing the compressed substance therein to break through the rupturable portion of the sealed seam and pass to the primary chamber.

According to one aspect of the invention, the nose portion is in the form of a narrow tube protruding into the secondary section and terminating in a V-shaped or U-shaped tip. In another form of the invention, the secondary chamber is of rectangular or tapered form and the nose portion protrudes into said chamber through its shorter side. In a further aspect of the invention, one or more secondary chambers are connectable with the primary chamber by means of one or more tubes, and two or more secondary chambers may be connectable with the primary chamber by means of an antechamber.

According to a special aspect of the invention, the primary chamber is sized and constructed to contain an X-ray film, one secondary chamber is adapted to be filled with a developing fluid, and the other secondary chamber is adapted to be filled with a fixing fluid.

Additional objects and advantages of the invention will become apparent during the course of the following specification when taken in connection with the accompanying drawings.

DETAILED DESCRIPTION OF THE PREFERRED EMBODIMENTS

Figure 1:
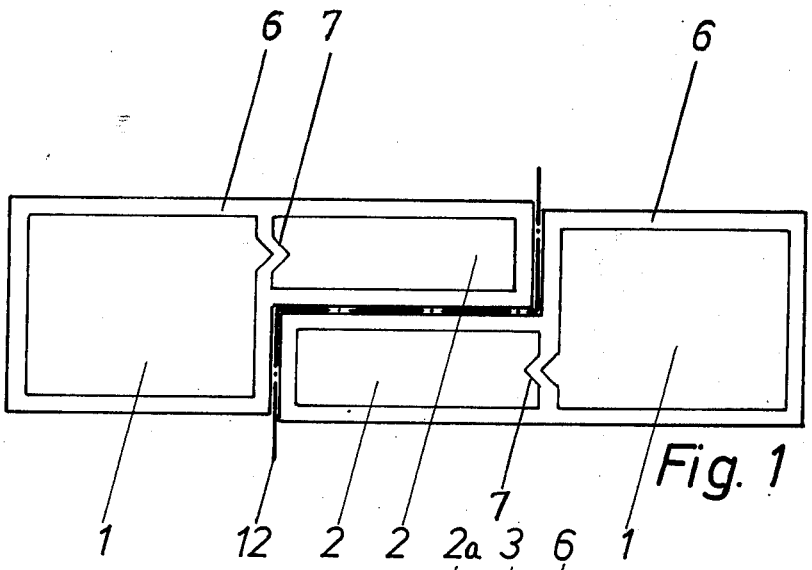
FIG. 1 is a plan view of one exemplary embodiment of compartmented package made in accordance with the invention.

FIG. 1 shows a combination of two compartmented packages separated from each other along the dot-and-dash line 12. Each of the packages comprises a primary chamber 1 and a secondary chamber 2, both chambers being bordered and separated from each other by means of sealing seams 6.

Figure 2:
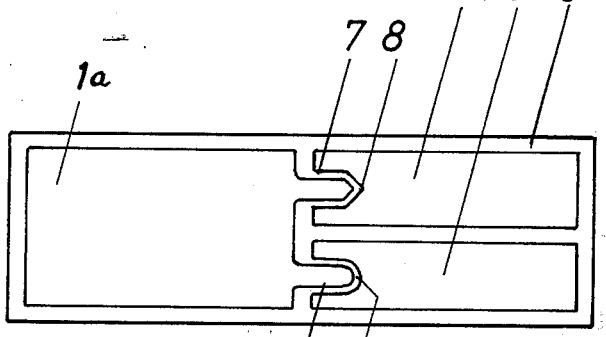
FIG. 2 is a plan view of another embodiment of the invention.

The multicompartmented package shown in FIG. 2 comprises a primary chamber 1*a* and two secondary chambers 2*a* and 3, the chambers being defined by sealing seams 6 which border the chambers and separate them from each other.

Figure 3:
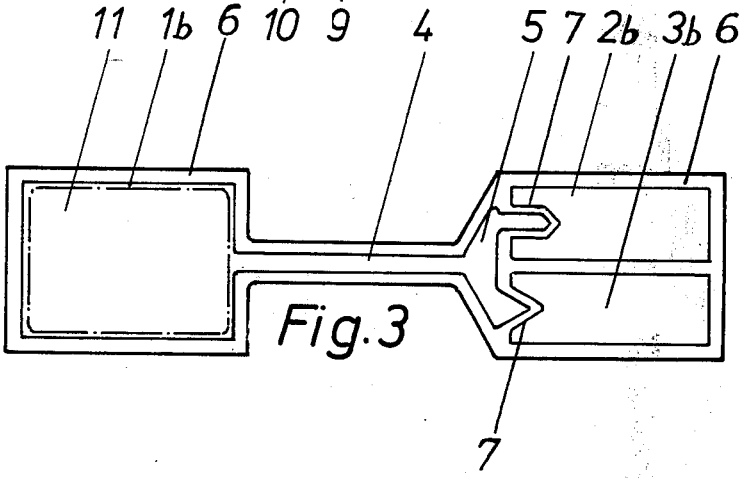
FIG. 3 is a plan view of a preferred embodiment of the invention.

The package shown in FIG. 3 comprises a primary chamber 1*b* and a pair of secondary chambers 2*b* and 3*b* positioned side by side. The secondary chambers 2*b* and 3*b* are attached to and connectable with the main chamber 1*b* by means of a tube 4 forming an antechamber 5 in front of the secondary chambers 2*b* and 3*b*. The tube 4 and antechamber 5 are bordered by and defined by the sealing seams 6.

The package shown in FIGS. 1, 2 and 3 may be made from a film in tubular form, from a film tape folded upon itself, or from two superimposed sheets of film, by means of providing longitudinal, transverse, and protrusion-forming sealing seams 6 which connect the layers of film. The seams 6 surround the main and secondary chambers and separate the chambers from each other. A part of each seam 6 separating the main chamber 1 from the secondary chambers 2 or 3 is formed as a destroyable nose portion 7 which may be ruptured under pressure. Each nose portion 7 protrudes into the secondary chamber and has a tapered end. As illustrated in FIG. 2, the nose portions 7 may be made in the form of elongated narrow tubes 10 terminating in V-shaped tips 8 or U-shaped tips 9. To permit easy rupturing of the destroyable nose portions 7, these seam portions may be made narrower than the widths of the sealing seams 6, as shown in FIGS. 2 and 3.

The compartmented packages may be made of flexible or rigid film of any thermoplastic plastic material suitable for the desired purpose. In some instances, monofilms such as PVDC may be employed, but for some applications the use of composite films, such as a combination of PVC, PVDC and PE, will be required to provide increased resistance to moisture and oxygen permeability, greater sealability, more ready delamination of the destroyable nose portion of the sealing seam where the latter connects the secondary and primary chambers. Compartmented packages for special purposes, such as X-ray film storage and processing, may be produced by using laminates of plastic film and aluminum foil.

The primary and secondary chambers of the compartmented package are intended to be filled with substances in fluid, paste or pulverized condition. The primary chamber 1, 1*a* or 1*b* may also contain a rigid substance to be processed or treated by the substances contained in the secondary chambers.

The package shown in FIG. 2 may be produced from a laminated film of light-tight material and contain a piece of X-ray film enclosed in its primary chamber 1*a*. The secondary chamber 2*a* may be filled with a developing fluid and the other secondary chamber 3 may be filled with a fixing fluid. After exposing the X-ray film enclosed in the chamber 1*a*, the destroyable nose portion 7 of the sealing seam is ruptured by means of exerting pressure on the secondary chamber 2*a*. The tractive forces induced in the sealing seam, by the pressure exerted on the secondary chamber 2*a*, effects a delamination of the destroyable nose portion 7, commencing at the V-shaped tip 8 of said nose portion. The content of the secondary chamber 2*a* is thus conducted over to the primary chamber 1*a* by squeezing or stretching the secondary chamber 2*a*. After the developing fluid has activated the latent image on the X-ray film, the developing fluid may be conducted back to the secondary chamber 2*a* by application of appropriate pressure. The fixing fluid is then conducted to the primary chamber 1*a* by applying pressure upon the secondary chamber 3, thus delaminating the destroyable nose portion 7 of its sealing seam commencing at the apex of the U-shaped tip 9, and then pushing the fixing fluid into the primary chamber 1*a* by manipulation of the flexible walls of the package.

In the handling of the package shown in FIG. 3, the substances contained in the secondary chambers 2*b* and 3*b* may be conducted over to the primary chamber 1*b* containing an X-ray film 11 in successive order, in the manner previously described, with each substance being conducted back to its original secondary chamber after use. Alternatively, both substances may be transferred at the same time into the primary chamber 1*b* by applying pressure simultaneously on both secondary chambers 2*b* and 3*b*, and mixing the two substances in the antechamber 5 before pressing the combined substances into the primary chamber 1*b*.

While preferred embodiments of the invention has been shown and described herein, it is obvious that numerous omissions, changes, and additions may be made in such embodiments without departing from the spirit and scope of the invention.

What is claimed is:

1. A flexible compartmented package comprising a primary chamber constituting a reaction or mixing chamber and at least one secondary chamber adapted to be filled with a substance to be transferred to the primary chamber, a sealed seam separating said primary chamber from said secondary chamber and having an intergral rupturable seam portion capable of being destroyed for establishing communication between said primary and secondary chambers, said rupturable seam portion being in the form of a nose protruding into said secondary chamber and having a tapered tip, said secondary chamber being entirely enclosed by said sealed seam to provide a pressure compartment for rupturing said nose and forcing said contained substance from said secondary chamber toward said first chamber when the walls of said secondary chamber are depressed.

2. A package according to claim 1 in which said tapered tip is of V-shape.

3. A package according to claim 1 in which said nose comprises a narrow tube terminating in said tapered tip and projecting into said secondary chamber.

4. A package according to claim 1 in which said secondary chamber is of substantially rectangular form having long sides and short sides, said nose protruding into said secondary chamber through one of said short sides.

5. A package according to claim 1 which includes at least two secondary chambers and at least one tube connecting said secondary chambers with said primary chamber.

6. A package according to claim 5 which also includes an antechamber connecting said secondary chambers with said tube.

7. A package according to claim 1 which includes two secondary chambers and in which said primary chamber is sized to contain an X-ray film, one secondary chamber is adapted to contain a film developing solution and the other secondary chamber is adapted to contain a film fixing solution.

8. A package according to claim 7 in which at least one of said chambers is made of a light-impermeable film with a high resistance to penetration of moisture and oxygen.

9. A package according to claim 8 in which said film is made of a lamination of PVC, PVDC and PE.

10. A package according to claim 7 in which at least the primary chamber is coated with aluminum foil.

* * * * *